US008251140B2

(12) United States Patent
Ramakrishnan et al.

(10) Patent No.: US 8,251,140 B2
(45) Date of Patent: Aug. 28, 2012

(54) FLUID MONITORING AND FLOW CHARACTERIZATION

(75) Inventors: Terizhandur S. Ramakrishnan, Boxborough, MA (US); Tarek M. Habashy, Burlington, MA (US); Badarinadh Vissapragada, Brookline, MA (US)

(73) Assignee: Schlumberger Technology Corporation, Sugar Land, TX (US)

( * ) Notice: Subject to any disclaimer, the term of this patent is extended or adjusted under 35 U.S.C. 154(b) by 336 days.

(21) Appl. No.: 12/559,800

(22) Filed: Sep. 15, 2009

(65) Prior Publication Data

US 2011/0061863 A1 Mar. 17, 2011

(51) Int. Cl.
*E21B 43/16* (2006.01)
*E21B 47/10* (2012.01)
*E21B 49/00* (2006.01)

(52) U.S. Cl. ..... 166/252.1; 73/152.38; 73/152.39; 166/66; 166/191; 166/250.01; 166/250.17

(58) Field of Classification Search ..... None
See application file for complete search history.

(56) References Cited

U.S. PATENT DOCUMENTS

| | | | | |
|---|---|---|---|---|
| 5,335,542 | A | 8/1994 | Ramakrishnan et al. | |
| 5,497,321 | A | 3/1996 | Ramakrishnan et al. | |
| 5,642,051 | A | 6/1997 | Babour et al. | |
| 6,061,634 | A | 5/2000 | Belani et al. | |
| 7,000,697 | B2 | 2/2006 | Goode et al. | |
| 7,040,390 | B2 * | 5/2006 | Tubel et al. | 166/64 |
| 7,040,402 | B2 | 5/2006 | Vercaemer | |
| 7,322,410 | B2 | 1/2008 | Vinegar et al. | |
| 2004/0256100 | A1 * | 12/2004 | Tubel et al. | 166/250.01 |
| 2008/0210420 | A1 * | 9/2008 | Ramakrishnan et al. | 166/250.02 |
| 2008/0215242 | A1 * | 9/2008 | Ramakrishnan | 702/7 |
| 2008/0257544 | A1 * | 10/2008 | Thigpen et al. | 166/250.01 |
| 2008/0262735 | A1 * | 10/2008 | Thigpen et al. | 702/6 |

FOREIGN PATENT DOCUMENTS

WO 2008106690 A2 9/2008

OTHER PUBLICATIONS

International Search Report of PCT Application Serial No. PCT/US2010/048365 dated May 30, 2011.

Kuchuk et al., "Determination of in-situ two-phase flow properties through downhole fluid movement monitoring", 2008 SPE Annual Technical Conference and Exhibition held in Denver, Colorado, Sep. 21-24, 2008, SPE 116068, 23 pages.

(Continued)

*Primary Examiner* — George Suchfield

(57) ABSTRACT

A wireline logging tool and method for fluid monitoring and flow characterization in individual zones of controlled salinity is disclosed. The tool and method advantageously facilitate zone-specific testing. Sets of packers are used to create hydraulically distinct zones proximate to the tool. Coiled tubing and isolation valves are used to selectively introduce and remove an electrically conductive fluid such as brine to and from a selected zone. Individual sensors are disposed near each zone to make zone-specific measurements while fluid properties are changed, e.g. while salinity is changed to cause salinity fronts in the formation.

13 Claims, 3 Drawing Sheets

OTHER PUBLICATIONS

Liang et al., "Inversion of induction logging data constrained by fluid-flow simulator", 2009 SPE Asia Pacific Oil and Gas Conference and Exhibition held in Jakarta, Indonesia Aug. 4-6, 2009, SPE 123355, 5 pages.

Ramakrishnan et al., "Water-cut and fractional-flow logs from array-induction measurements", SPE Reservoir Eval. & Eng. 2 (1), Feb. 1999, pp. 85-94.

Zhan, et al., "Characterization of reservoir heterogeneity through fluid movement monitoring with deep electromagnetic and pressure measurements", 2008 SPE Annual Technical Conference and Exhibition held in Denver, Colorado, Sep. 21-24, 2008, SPE 116328, 16 pages.

* cited by examiner

FLUID MONITORING AND FLOW CHARACTERIZATION

FIELD OF THE INVENTION

This invention is generally related to evaluation of subterranean formations, and more particularly to fluid monitoring and flow characterization based on resistivity measurements in zones of individually controlled brine injection.

BACKGROUND OF THE INVENTION

Reservoir multiphase transport properties such as relative permeability and capillary pressure are important parameters for reservoir characterization, management, forecasting, and performance analysis. It is known to use wireline logging tools to measure native formation resistivity in order to help estimate multiphase flow parameters. For example, co-owned U.S. Pat. No. 5,335,542 describes characterization of formation properties by combining probe pressure measurements with resistivity measurements from electrodes mounted on a pad in wireline formation tester. As fluid is withdrawn or injected into the formation at known rates, the fluid pressure of the formation and electromagnetic data are obtained. The electromagnetic and fluid pressure data can then be processed using various formation and tool models to obtain relative permeability information, endpoint permeability and wettability.

Drilling mud is usually weighted to maintain wellbore hydrostatic pressure above that of the formation in order to prevent the well from blowing out. This causes borehole fluids to enter the formation. Further, as the borehole fluids enter the formation, a mudcake is deposited on the borehole surface. The presence of a fluid-invaded region and mudcake around the borehole distorts the logs and can therefore make interpretation difficult. Conversely, the displacement of one fluid by another leads to a characteristic signature that may be used to infer multiphase flow properties, provided the underlying physics is taken into account, such as described in U.S. Pat. No. 5,497,321.

One problem with calculating multiphase transport properties based on measured resistivity is that aspects of intentional fluid introduction and resistivity measurement are difficult to control. For example, it is difficult to create timely and uniform changes in salinity within the borehole from which distinct fronts of contrasting salinity would be created. Also, electrical pathways within the borehole and along the borehole wall can affect formation resistivity measurement. This is described in U.S. Pat. No. 6,061,634.

SUMMARY OF THE INVENTION

In accordance with one embodiment of the invention apparatus for performing tests on a subterranean formation from a borehole comprises: hydraulic isolators which create a plurality of hydraulically distinct zones when actuated; at least one hydraulic conduit for introducing fluid to the hydraulically distinct zones; and a plurality of sensors for obtaining measurements of formation resistivity adjacent to ones of the hydraulically distinct zones as fluids of different conductivity are introduced to those hydraulically distinct zones via the at least one hydraulic conduit.

In accordance with another embodiment of the invention a method for performing tests on a subterranean formation from a borehole comprises: creating a plurality of hydraulically distinct zones; introducing fluids of different conductivity to at least one of the hydraulically distinct zones via the at least one hydraulic conduit; and obtaining measurements of formation resistivity adjacent to ones of the hydraulically distinct zones as the fluids of different conductivity are introduced.

Embodiments of the invention help to overcome some of the problems mentioned above. For example, the creation of hydraulically distinct zones enhances creation of timely and uniform changes in salinity within the borehole from which distinct fronts of contrasting salinity are created. Also, undesirable electrical pathways within the borehole and along the borehole wall that affect formation resistivity measurement can be mitigated by disposing sensors on the hydraulic isolators, e.g. on packers that are placed in contact with the borehole wall.

DETAILED DESCRIPTION

Figure 1:
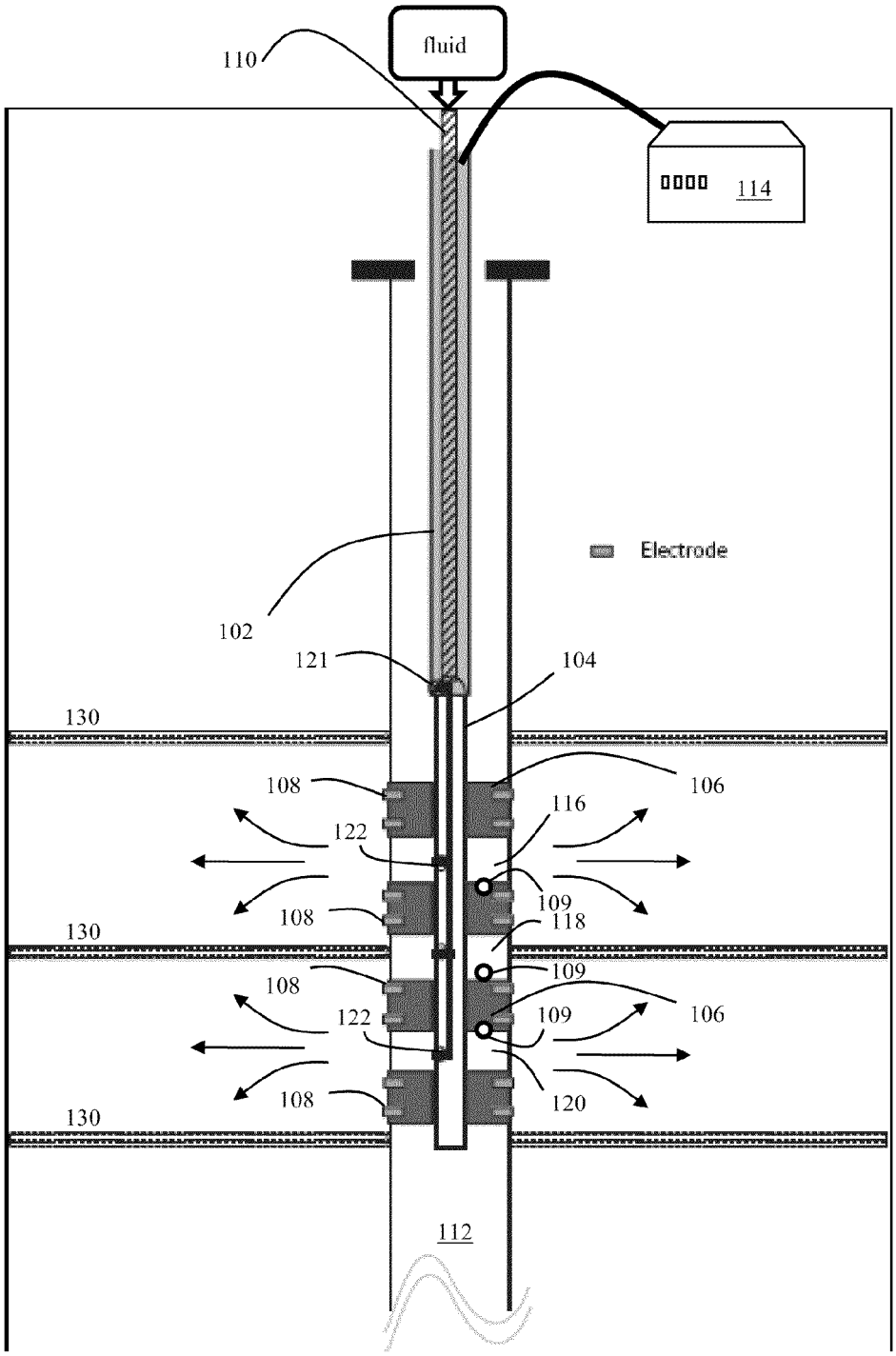
FIG. 1 illustrates a wireline logging tool for fluid monitoring and flow characterization in individual zones of controlled salinity wherein the sensors are disposed on the packers.

FIG. 1 illustrates a wireline logging tool for fluid monitoring and flow characterization in individual zones of controlled salinity. The illustrated tool includes a body 102, coiled tubing 104, hydraulic isolators 106 such as a plurality of packers, a plurality of electromagnetic sensors 108, and other sensors 109 including pressure sensors, flow sensors, and temperature sensors. The tool is suspended from an armored cable 110 which extends from a borehole 112 over a sheave wheel on a derrick to a winch forming part of surface equipment, which may include an analyzer unit 114. Well known depth gauging equipment (not shown) may be provided to measure cable displacement over the sheave wheel. The tool may include any of many well known devices to produce a signal indicating tool orientation. Processing and interface circuitry within the tool is operable to amplify, sample and digitize information signals for transmission and communicates them to the analyzer unit via the cable. Electrical power and control signals for coordinating operation of the tool may be generated by the analyzer unit or some other device, and communicated via the cable to circuitry provided within the tool. The surface equipment includes a processor subsystem which may include a microprocessor, computer readable memory, clock and timing, and input/output functions, standard peripheral equipment, and a recorder, all of which may be integrated into the analyzer unit 114. Any software associated with features of the embodiments may be stored on the computer readable memory.

The tool can be used to create distinct zones and implement zone-specific testing. The sets of packers which abut the borehole wall when inflated are used to create hydraulically distinct zones 116, 118, 120 proximate to the tool. More particularly, a hydraulically distinct zone is defined within the borehole between adjacent sets of inflated packers. The zones are hydraulically distinct because the packers impede fluid flow within the borehole between different zones. The number and position of the packers may be configured for a particular borehole or formation. Once the zones have been created, the coiled tubing 104 in conjunction with flowline branches in the tool are used to displace fluid in the zones with a new fluid having a different characteristic electrical conductivity, e.g., injecting a brine solution to increase conductivity. In particular, a main valve 121 is connected between the coiled tubing and the tool and a branch line connected to the tubing via a valve 122 is used to introduce fluid supplied from a surface reservoir via a pump. In order to individually service each potential zone, individual branch lines may be connected to the tubes at each zone. A wireline disposed within the coiled tubing communicates commands to actuate the valves individually or in one or more groups. Any of various techniques known in the art, including but not limited to using borehole fluid or bypass fluid, can be used to control inflation and deflation of individual packers. Flow rate in each zone and total flow rate are monitored with flow meters. Consequently, controlled actuation of main valve 121 and individual valves 122 enables zone-specific control of fluid introduction so that fluid characteristic type and concentration can be independently changed and simultaneously different in different zones. A practical advantage of this feature is that each zone can simultaneously be subjected to a different salinity schedule. As described in published U.S. patent publication 2008/0210420, by Ramakrishnan et al. having Ser. No. 12/041,576, entitled "METHOD FOR IMPROVING THE DETERMINATION OF EARTH FORMATION PROPERTIES," filed 3 Mar. 2008, which is incorporated by reference, injection of fluids of different salinity at different points in time creates a plurality of salinity fronts propagating into the formation, which improves the sensitivity of measurements to multiphase flow functional properties such as relative permeability and capillary pressure.

Although the use of multiple salinity fronts improves results, an inability to control inter-layer fluid flow rate also affects the ability to infer horizontal and vertical movement of fluid. The illustrated tool helps to overcome this problem. The location of the hydraulically distinct zones relative to boundary layers 130 may be adjusted by moving the tool within the borehole using the cable, selectively actuating sets of packers, and selectively actuating isolation valves. One or more of these techniques can be employed to configure the tool to communicate to the formation at intervals of choosing. For example, the tool may be configured such that the hydraulically distinct zones under test do not traverse boundary layers. The approximate location of boundary layers relative to the tool can be detected by various sensors, as known in the art. The adjacent packers which define a hydraulically distinct zone are then selected and actuated such that certain zones do not traverse boundary layers, e.g. zones 116, 120. Depending on the desired zone size and inter-packer distance relative to the distance between boundary layers it may be desirable to reposition the tool within the borehole before actuating the packers. It is of course recognized that the isolation provided by the packers is not absolute, but is rather sufficient for the measurements being made by the tool. Once the packers are actuated, the isolation valves are employed to inject fluid into different zones. Because creation of some hydraulically distinct zones that traverse formation layer boundaries may be unavoidable, it may be desirable to identify such zones and exclude them from testing. For example, boundary-traversing zone 118 defined between two non-traversing zones 116, 120 would not be subjected to changes in salinity or resistivity measurements.

Figure 2:
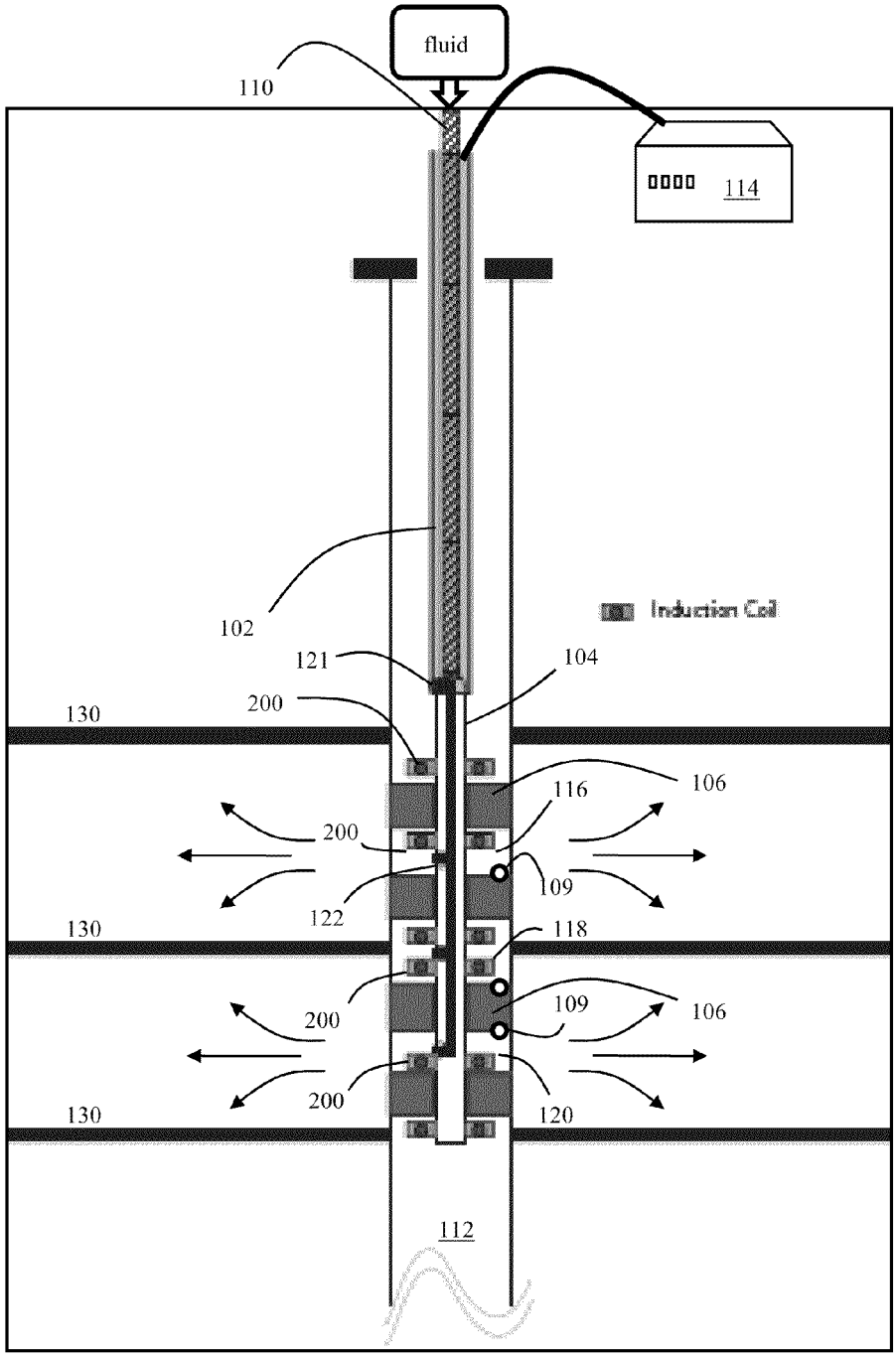
FIG. 2 illustrates an alternative embodiment in which the sensors include an array of induction coils interspaced between the packers.

The sensors can be implemented using various electrical and electromagnetic technologies. In one embodiment of the invention the sensors 108 are disposed on the packers. As an example, electrode segmented or overlapping ring sensors may be disposed on the packers (not shown). This advantageously enables the electrodes to be in contact with the formation as fluid salinity is changed. Further, by having large area sectors, a significant current may be injected. Alternatively, referring now to FIGS. 1 and 2, the sensor may include an array of induction coils 200 (which may be tri-axial), interspaced between the packers, and mounted within suitable insulators. Although not specifically shown, both the electrode rings of FIG. 1 and induction coils of FIG. 2 could be included in one tool. In order to facilitate operation, sensors may be individually controlled.

It will be appreciated by those skilled in the art that the other sensors 109 are utilized to obtain other information to be used with information from the electrical or electromagnetic sensors 108 to calculate characteristics such as relative permeability, endpoint permeability and wettability. For example, a record of changes in the fluid pressure, fluid flow rate into the formation and fluid temperature for a particular zone would be used along with data indicative of resistivity to produce information of greater value to the operator in accordance with techniques generally known in the art.

Those skilled in the art will recognize that the illustrated tool may be used for various other tests. For example, flow rates can be adjusted using the valves to conduct fall-off tests. Fall-off pressure can also be acquired following a complete shutdown.

In an alternative embodiment the tool is adapted for $CO_2$ sequestration injection. In this alternative embodiment, $CO_2$ injection fluid is pumped via the coiled tubing. More particularly, non-conductive $CO_2$ displaces the conductive brine. Because the presence of $CO_2$ increases formation resistivity significantly, profiling measurements obtained in this manner are a good indicator of interval uptakes, and also may be used to measure downhole relative permeabilities. It is also possible to infer anisotropy of the formation from the inferred $CO_2$ migration pathways.

Additional applications include injection of enhanced oil recovery (EOR) agents such as surfactants and polymers and combinations thereof for evaluating their potential for improving oil recovery. A simple example would be to quantify improved oil displacement as a result of fluid injection.

Figure 3:
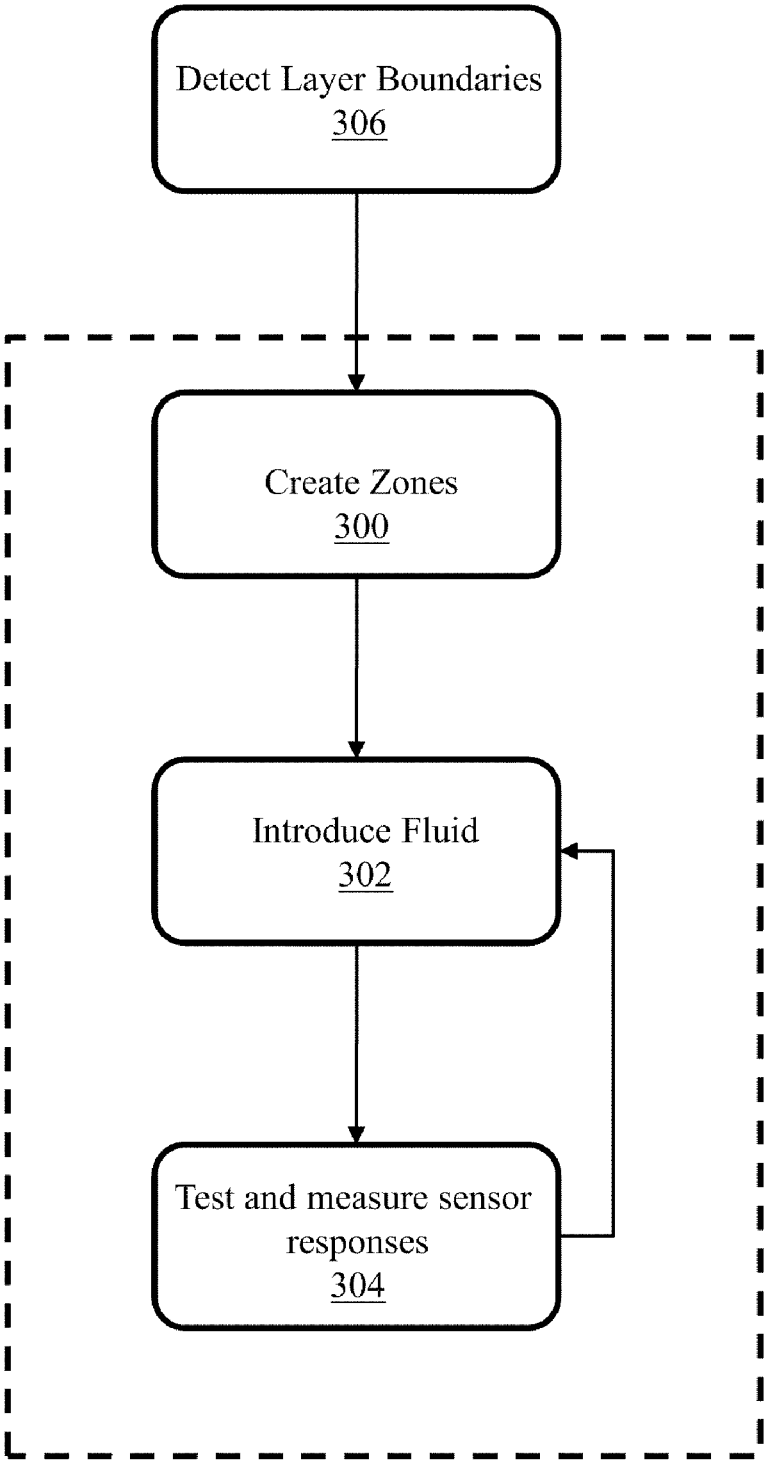
FIG. 3 illustrates a method in accordance with embodiments of the invention.

FIG. 3 illustrates a method in accordance with embodiments of the invention. The method includes three main steps: creating a plurality of hydraulically distinct zones in step 300; introducing fluids of different conductivity to at least one of the hydraulically distinct zones via the at least one hydraulic conduit in step 302; and obtaining measurements of formation resistivity adjacent to the hydraulically distinct zones as the fluids of different conductivity are introduced in step 304. Prior to creating the hydraulically distinct zones it may be desirable to detect layer boundaries in the formation at step 306 so that any hydraulically distinct zones which traverse a detected layer boundary can be excluded from testing. The step of introducing fluid of different characteristics can include introducing different fluids to different ones of the hydraulically distinct zones, i.e., different salinity schedules for different zones with simultaneous testing in the zones. The step can also include displacing brine with $CO_2$ to increase formation resistivity while obtaining measurements. Alternative testing steps include adjusting fluid flow rate to a conduct fall-off test and acquiring fall-off pressure following a complete shutdown.

While the invention is described through the above exemplary embodiments, it will be understood by those of ordinary skill in the art that modification to and variation of the illustrated embodiments may be made without departing from the inventive concepts herein disclosed. Moreover, while the preferred embodiments are described in connection with various illustrative structures, one skilled in the art will recognize that the system may be embodied using a variety of specific structures. Accordingly, the invention should not be viewed as limited except by the scope and spirit of the appended claims.

What is claimed is:

1. A method for performing tests on a subterranean formation from a borehole comprising:

creating a plurality of hydraulically distinct zones;

introducing fluids of different conductivity to at least one of the hydraulically distinct zones via at least one hydraulic conduit; and obtaining measurements of formation resistivity adjacent to ones of the hydraulically distinct zones as the fluids of different conductivity are introduced.

2. The method of claim 1 including creating the hydraulically distinct zones by actuating packers.

3. The method of claim 2 including obtaining measurements with overlapping sectored electrode ring sensors disposed on the packers.

4. The method of claim 2 including obtaining measurements with an array of induction coils interspaced between the packers and mounted within insulators.

5. The method of claim 2 including obtaining measurements with an array of tri-axial induction coils interspaced between the packers and mounted within insulators.

6. The method of claim 1 including obtaining measurements with segmented electrode ring sensors disposed on the packers.

7. The method of claim 1 further including detecting layer boundaries in the formation.

8. The method of claim 7 further including excluding from testing any hydraulically distinct zones which traverse a detected layer boundary.

9. The method of claim 1 further including introducing fluid of different characteristics to different ones of the hydraulically distinct zones.

10. The method of claim 1 further including adjusting fluid flow rates to conduct injection and fall-off tests.

11. The method of claim 1 further including acquiring injection and fall-off pressure.

12. The method of claim 1 further including displacing brine with $CO_2$.

13. The method of claim 1 further including displacing reservoir fluids with enhanced recovery agents.

* * * * *